US007178630B1

(12) United States Patent
Perdue

(10) Patent No.: US 7,178,630 B1
(45) Date of Patent: Feb. 20, 2007

(54) ACOUSTIC DEVICE FOR WALL MOUNTING FOR DIFFUSION AND ABSORPTION OF SOUND

(76) Inventor: Jay Perdue, 4210 Hester Dr., Amarillo, TX (US) 79124

( * ) Notice: Subject to any disclaimer, the term of this patent is extended or adjusted under 35 U.S.C. 154(b) by 327 days.

(21) Appl. No.: 10/928,884

(22) Filed: Aug. 30, 2004

(51) Int. Cl.
*E04B 1/82* (2006.01)
*E04B 2/02* (2006.01)

(52) U.S. Cl. ..... 181/290; 181/295

(58) Field of Classification Search ..... 181/290, 181/30, 295, 286
See application file for complete search history.

(56) References Cited

U.S. PATENT DOCUMENTS

| | | | | | |
|---|---|---|---|---|---|
| 1,758,808 | A | * | 5/1930 | Sersen et al. | 181/30 |
| 2,160,638 | A | * | 5/1939 | Bedell et al. | 181/30 |
| 2,390,262 | A | * | 12/1945 | Mazer | 52/506.01 |
| 2,502,019 | A | * | 3/1950 | Olson | 181/295 |
| 2,502,020 | A | * | 3/1950 | Olson | 181/295 |
| 2,556,884 | A | * | 6/1951 | Muller | 181/290 |
| 2,715,449 | A | * | 8/1955 | Smith et al. | 181/30 |
| 3,182,747 | A | * | 5/1965 | Wilhelmi et al. | 181/286 |
| 3,316,999 | A | * | 5/1967 | Jaffe et al. | 181/30 |
| 3,498,405 | A | * | 3/1970 | Charpentier | 181/291 |
| 3,819,010 | A | * | 6/1974 | Adams et al. | 181/295 |
| 4,226,299 | A | * | 10/1980 | Hansen | 181/284 |
| 4,319,661 | A | * | 3/1982 | Proudfoot | 181/295 |
| 4,356,880 | A | * | 11/1982 | Downs | 181/30 |
| 4,393,631 | A | * | 7/1983 | Krent | 52/144 |
| 4,441,581 | A | * | 4/1984 | Sommerhalder | 181/286 |
| 4,548,292 | A | | 10/1985 | Noxon | |
| 4,611,687 | A | * | 9/1986 | Nixon | 181/286 |
| 5,035,298 | A | * | 7/1991 | Noxon | 181/295 |
| 5,137,111 | A | * | 8/1992 | Diduck et al. | 181/295 |
| 5,141,073 | A | * | 8/1992 | Pelonis | 181/30 |
| 5,317,113 | A | * | 5/1994 | Duda | 181/285 |
| 5,362,931 | A | * | 11/1994 | Fries | 181/284 |
| 5,444,198 | A | * | 8/1995 | Gallas | 181/295 |
| 5,623,130 | A | * | 4/1997 | Noxon | 181/30 |
| 5,644,872 | A | | 7/1997 | Perdue | |
| 5,665,943 | A | * | 9/1997 | D'Antonio | 181/295 |
| 5,992,561 | A | * | 11/1999 | Holben et al. | 181/295 |
| 6,073,722 | A | * | 6/2000 | Babuke et al. | 181/30 |
| 6,158,176 | A | * | 12/2000 | Perdue | 52/144 |
| 6,209,680 | B1 | | 4/2001 | Perdue | |
| 2003/0006092 | A1 | * | 1/2003 | D'Antonio et al. | 181/293 |

* cited by examiner

*Primary Examiner*—Edgardo San Martin
(74) *Attorney, Agent, or Firm*—Norman B. Rainer

(57) ABSTRACT

A wall-mountable acoustic device for absorption of sound in an indoor area is constructed of self-supporting interbonded rockwool mat material. The primary component made of the mat material is shaped in semi-cylindrical configuration. End panels of rockwool mat of similar composition are attached to the opposite ends of the semi-cylindrical configuration to enclose the configuration except for an open rear extremity of rectangular perimeter. When attached to a flat wall, a totally enclosed semi-cylindrical chamber is defined. In a preferred embodiment, further improvement of sound absorption properties is achieved by way of a diaphragm disposed within the semi-cylindrical configuration.

16 Claims, 5 Drawing Sheets

ACOUSTIC DEVICE FOR WALL MOUNTING FOR DIFFUSION AND ABSORPTION OF SOUND

BACKGROUND OF THE INVENTION

1. Field of the Invention

This invention relates to devices employed for modifying the acoustic characteristics of large indoor areas bounded by vertical wall structure, and more particularly concerns a device which, when mounted upon at least one wall of a room achieves controlled selective diffusion and absorption of sound within said room.

2. Description of the Prior Art

It is often sought to diminish the noise level in indoor rooms, auditoriums, gymnasiums, restaurants, hallways, cafeterias, manufacturing plants and other indoor areas. In theaters where music is performed, the quality of the music heard by the audience is enhanced when the acoustic characteristics of the theater minimizes echoes, reverberations and ambient noise.

Various types of sound-absorbing rigid panel products have been employed as ceiling tiles, and various rigid and soft wall coverings have been disclosed for sound absorption. In most cases the sound-absorbing panels constitute a uniform array in their wall or ceiling installations. It has been found however, that panels intended to alter the characteristics of sound in an indoor enclosure are of greatest effectiveness when the nature and placement of the panels is custom-designed to accommodate the characteristics of the area being serviced and the type of sound encountered.

In situations where a customized sound-interactive system is being installed, it is often necessary to employ considerable trial and testing to optimize the system in terms of the types of panels employed, and their placement and interrelationships. An array of acoustic wall panels may, for example be comprised of an interactive assembly of different panels whose individual specific functions are to reflect, diffuse or absorb sound. With suitable trial and testing, the most suitable combination and arrangement may be found for the various panels.

Flat rectangular sound absorbing panels suitable for wall mounting in an abutting assemblage are disclosed in U.S. Pat. Nos. 5,644,872; 6,158,176 and elsewhere. Sound absorbing wall panels having trapezoidal or wedge shapes are disclosed in U.S. Pat. Nos. 5,141,073 and 6,209,680. Panels having a plurality of projections for the purpose of minimizing reflection of sound are disclosed in U.S. Pat. No. 3,498,405. Pyramidal panels for enhancing reflection of sound in an audience area are disclosed in U.S. Pat. No. 4,356,880.

U.S. Pat. No. 4,548,292, which concerns a floor-standing acoustic device of cylindrical shape adapted to be located in a corner of a room, discusses the difficulties in absorbing low frequency sounds, namely sounds having a frequency below 125 Hz. U.S. Pat. No. 4,319,661 discloses cylindrical acoustic devices equipped with Helmholtz resonators for absorption of low frequency sound. The Helmholtz resonators are generally defined to be comprised of a hollow chamber bounded in part by a perforated rigid panel. Although effective, Helmholtz resonators are usually heavy because of the nature of the rigid panel, which is generally of metal construction.

Although the aforementioned acoustic devices provide specialized advantages in selected installations, further improvement is needed, especially where the devices can provide versatility of performance in accommodating the specific requirements of different indoor areas.

It is accordingly an object of the present invention to provide a wall-mountable acoustic device for desirably modifying the subjectively perceived quality of sound in an indoor area.

It is another object of this invention to provide an acoustic device as in the foregoing object which is highly efficient in absorbing low frequency noise.

It is a further object of the present invention to provide an acoustic device of the foregoing object which is easily mountable upon a substantially flat wall surface.

It is a still further object of this invention to provide an assemblage of a plurality of the aforesaid acoustic devices uniformly mounted upon a vertical wall surface.

An additional object of the present invention is to provide an acoustic device of the aforesaid nature of light weight, fireproof construction amenable to low cost manufacture.

It is yet another object of this invention to provide an acoustic device of the aforesaid nature having an anesthetically pleasing appearance.

These objects and other objects and advantages of the invention will be apparent from the following description.

SUMMARY OF THE INVENTION

The above and other beneficial objects and advantages are accomplished in accordance with the present invention by a wall-mountable acoustic device for diffusion and absorption of sound in an indoor area, comprising:

a) a self-supporting mat of compacted and interbonded rockwool fibers, said mat linearly elongated between opposite end extremities and bounded by 1) a convex exterior surface of circular cylindric shape extending 180° in circular curvature, 2) a concave interior surface substantially concentric with said exterior surface and extending 180° in circular curvature, 3) two diametrically opposed straight flat rear surfaces in parallel and coplanar juxtaposition, having identical widths which represent the thickness of the mat as measured orthogonally between said interior and exterior surfaces, and 4) opposed flat end surfaces having a semicircular perimeter, b) a thin facing material tautly embracing said exterior surface and extending across said rear surfaces and onto said interior surface, and c) an end panel of flat contour disposed upon each end surface and extending between said exterior surface and rear surfaces, whereby, d) when said device is mounted upon a wall by way of abutment with said rear surfaces, said mat, end panels and wall define a fully enclosed internal chamber of semi-cylindrical configuration.

BRIEF DESCRIPTION OF THE DRAWING

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENT

Figure 1:
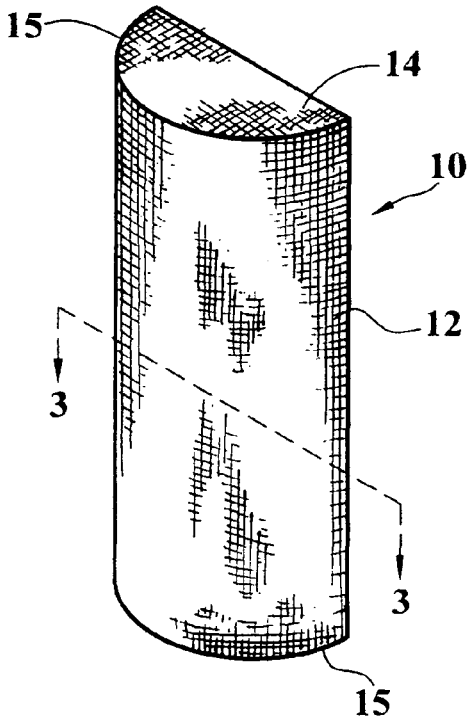
FIG. 1 is a front, top and side perspective view of a first embodiment of the acoustic device of the present invention.
Figure 2:
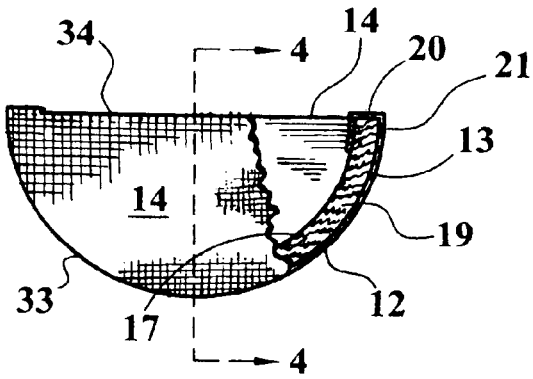
FIG. 2 is an enlarged top view thereof, with portions broken away to reveal interior details.
Figure 3:
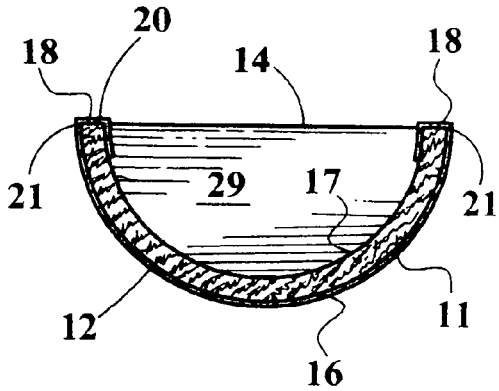
FIG. 3 is an enlarged lateral sectional view taken in the direction of the arrows upon line 3—3 of FIG. 1.

Referring now to FIGS. 1–4, an embodiment of the acoustic device 10 of this invention is shown comprised of mat 11 assembled with end panels 14, said assembly being covered by a facing material in the form of fabric 12.

Mat 11 is self-supporting, constructed of compacted and interbonded rockwool fibers, and is linearly elongated between opposite end extremities 15. Said mat is bounded by convex exterior surface 16 of circular cylindric shape extending 180° in circular curvature, concave interior surface 17 substantially concentric with said exterior surface and also extending 180° in circular curvature, two diametrically opposed straight flat rear surfaces 18 in parallel and coplanar juxtaposition, and opposed flat end surfaces 19 having a semicircular contour 13. Said rear and end surfaces have an identical width 20 which represents the thickness of the mat, namely the orthogonally measured distance of separation between said interior and exterior surfaces.

The thickness of the mat may range between 1 and 3 inches, and the length of the mat, measured between end extremities 15, may range between 2 and 6 feet. The diametric width of the mat, measured between the outer edges 21 of said rear surfaces, is preferably between 16 and 30 inches. The ratio of the length to diametric width of the mat is preferably between 1.4 and 3.0. The ratio of the thickness of the mat to the diametric width is preferably in the range of 0.06 to 0.12.

The rockwool fiber mat 11 has a density preferably between 5 and 9 pounds per cubic foot. The individual rockwool fibers of the mat are interbonded with a bonding agent typically of a thermoset chemical nature. Exemplary bonding agents include: phenol-formaldehyde, urea-formaldehyde and melamine-formaldehyde compositions. During manufacture, such compositions, in low viscosity aqueous formulations, are sprayed onto freshly formed rockwool fibers in a manner to achieve uniform treatment in a conveyor belt operation. The treated fibers are then pressed to the desired degree of compaction and routed through a curing oven where the water solvent is driven off and the bonding agent undergoes chemical cross-linking to a cured thermoset state. Sufficiently small amounts of the bonding agent composition is employed so as to avoid occlusion of the interstitial spaces between fibers. Because of its low viscosity, the formulation merely coats the fibers, and the coating flows along the fiber until it meets a cross contacting fiber. The formulation remains at the cross over site of said contacting fibers until curing occurs. By virtue of such method of interbonding, the intrinsic properties of the rockwool fibers are unaffected, and the collective characteristics of the mat are not compromised. The preferred amount of bonding agent in the rockwool mat is about 3% to 5% based upon the overall weight of the mat. Lesser amounts of bonding agent will not secure adequate integration of the mat, and greater amounts of bonding agent will diminish certain sought properties of the mat.

The expression "self-supporting", as employed herein is intended to denote a structure which will retain its shape unaidedly. As definitive measures of the self-supporting nature of mat 11, said mat, in flat form, will exhibit a sag of not more than ¼" in 4 feet when horizontally supported at one end. It will also have a tensile strength of at least 2600 pounds per square foot, and a compressive modulus between about 300 and 500 pounds per square foot, measured at 10% compression. The rockwool fibers of said mat are preferably arranged in layers concentric with said interior and exterior surfaces. Such characteristics of the mat are of critical importance not only in achieving structural stability of the acoustic device, but also in achieving the sought specialized sound-modifying characteristics.

Figure 6:
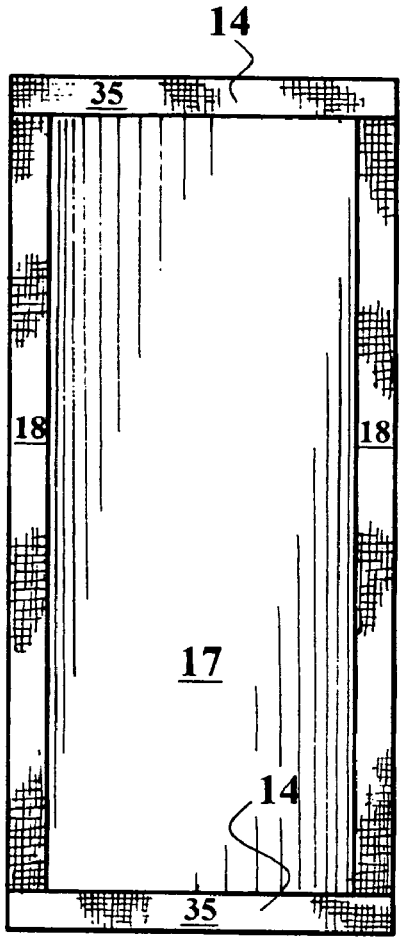
FIG. 6 is a rear view of the acoustic device of FIG. 1.

Top and bottom end panels 14, having flat interior and exterior faces 27 and 28, respectively, are adhesively secured to end surfaces 19. Said end panels are preferably comprised of the same type of compacted interbonded rockwool composition that constitutes mat 11. The thickness of said end panels, measured between said interior and exterior surfaces, is preferably similar to the thickness of mat 11. Said interior and exterior faces have identical perimeters consisting of arcuate forward edges 33 congruent with convex exterior surface 16, and straight rear edges 34 which define back surfaces 35. Said back surfaces 35 are disposed in coplanar relationship with rear surfaces 18 of said mat in a rectangular configuration, as shown in FIG. 6, and are preferably hardened by way of treatment with a resin composition. Such hardening facilitates securement of the acoustic device to a wall by way of brackets that insert into said rear and/or back surfaces.

Fabric facing material 12 is preferably comprised of fiberglass, and may be of woven construction such as square weave, or a scrim or non-woven sheet stabilized by a flexible rear surface coating. Said fabric, with the aid of adhesive bonding, is caused to tautly embrace said convex exterior surface and top and bottom end panels 14, and extend across said rear surfaces and onto said interior surfaces. The combination of fiberglass facing material disposed upon a rockwool structure causes such embodiment of the acoustic device to be totally fire-resistant. In other embodiments, the facing material may be a plastic film such as perforated polyvinylchloride.

The acoustic device of this invention, when tested for sound absorption by way of ASTM Test C423-90a, can provide a noise reduction coefficient (NRC) above, namely better than 1.20 at sound frequencies in the range of 50 Hz–125 Hz, and NRC in the range of 1.7 to 2.59 at sound frequencies above 125 Hz.

A further understanding of my invention will be had from a consideration of the following example which illustrates certain preferred embodiments. It is understood that the instant invention is not to be construed as being limited by said example or by the details therein.

EXAMPLE 1

An acoustic device of the present invention was selected for testing purposes, said device having a length, measured between said opposed end surfaces, of 36 inches, a width, measured between end extremities 15, of 28 inches, a semi-circularly contoured mat of interbonded rockwool fibers having a density of 96.1 kg/m$^3$ (6 pounds per cubic foot) and thickness of two inches; top and bottom end panels 14 being fabricated of the same mat material; and an outside covering of Guilford Fabric FR701, Style 2100 adhered to the convex outer face of the mat by way of a thin layer of adhesive at the edges and returned to the rear interior surface of the mat.

Figure 10:
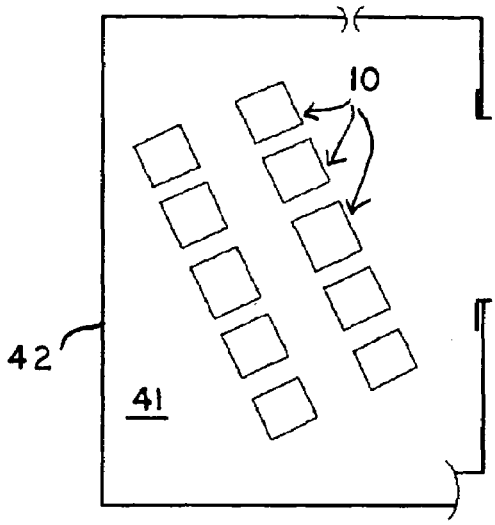
FIG. 10 is a plan view of a testing chamber room which accommodates the assemblage of FIG. 9.
Figure 9:
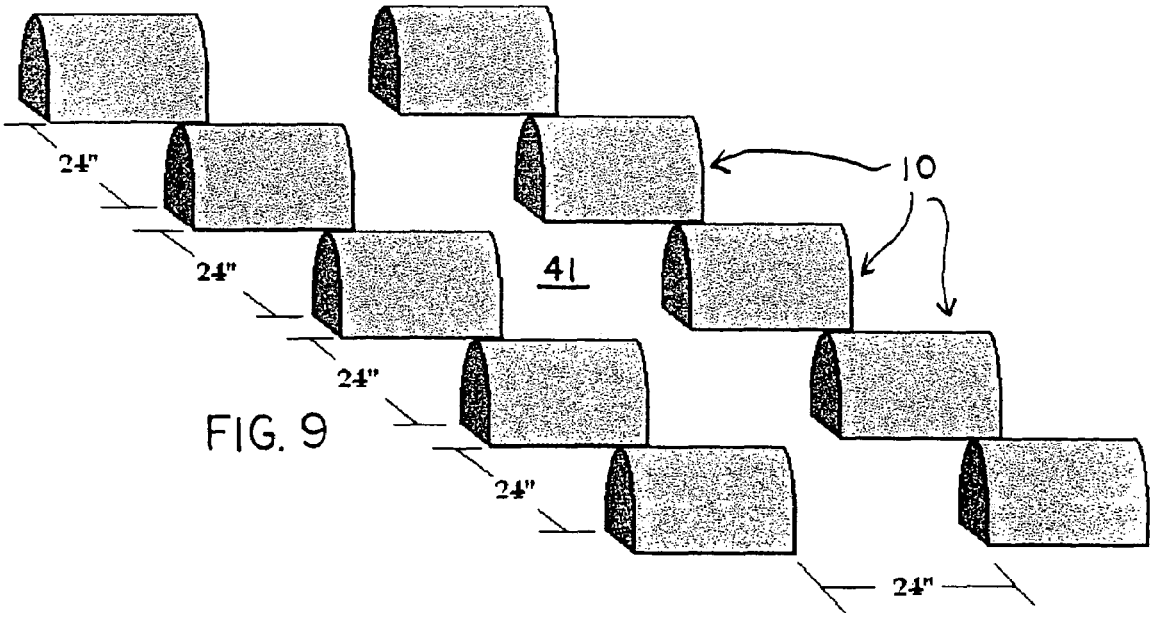
FIG. 9 is a perspective view of an assemblage of said acoustic devices arranged for testing purposes.

Ten identical specimens of the aforesaid acoustic device were arranged on the floor 41 of a reverberation chamber 42 as shown in FIGS. 9 and 10. The reverberation chamber has a volume of 254 m$^3$. Testing was conducted in accordance with Section 9.3 of ASTM C423-90a.

Figure 11:
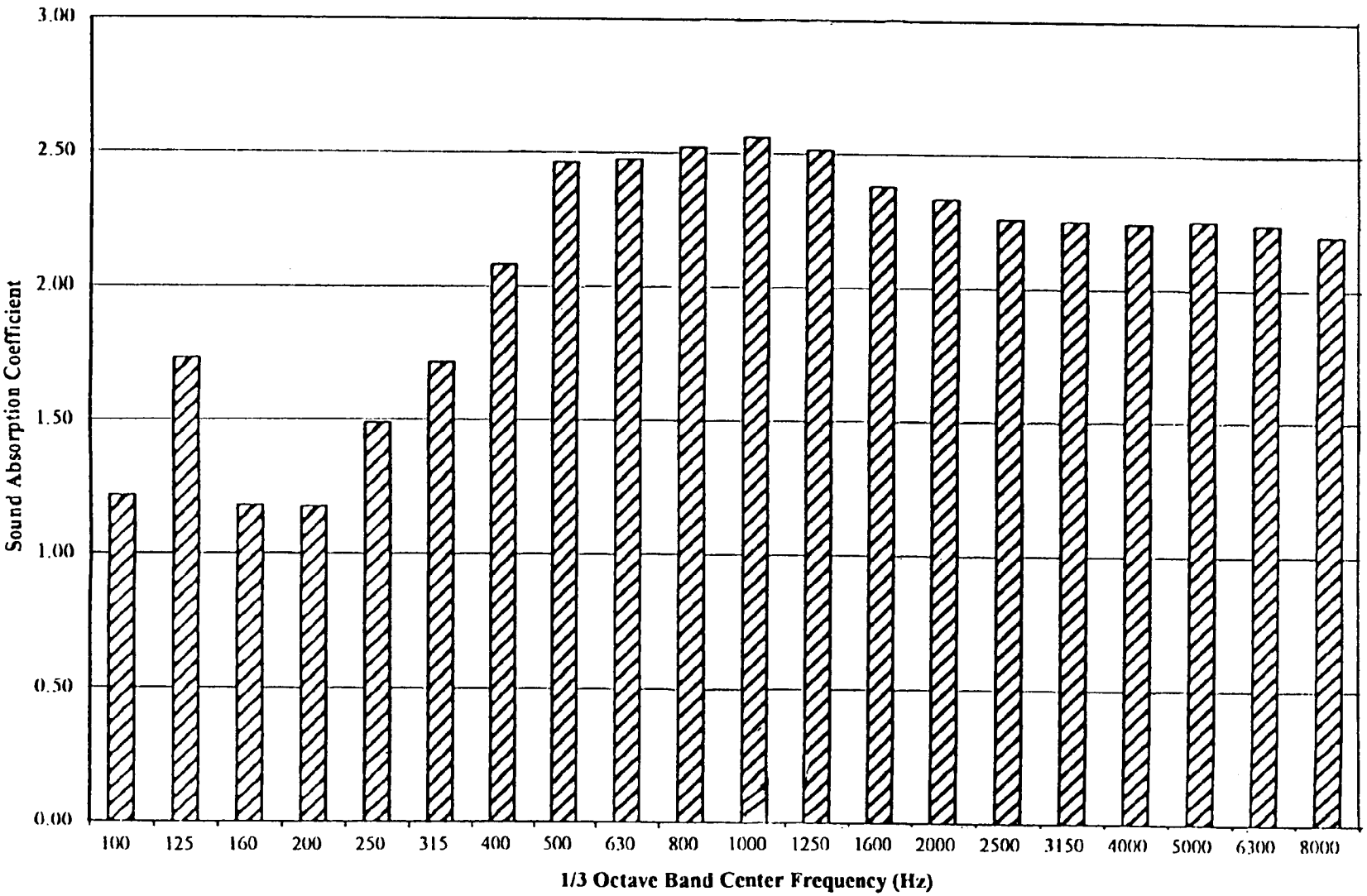
FIG. 11 is a graphical presentation of data obtained by testing the assemblage of FIG. 9.

The decay rate of sound (which is inversely relative to sound absorption) was measured upon terminating a steady-state broadband pink noise signal within the reverberation chamber. Five ensemble averages containing 32 decays each were measured with both the test specimens inside of and removed from the chamber. The difference between these sound absorptors at a given frequency is defined as the sound absorption of the specimen. The Sound Absorption Coefficient is the sound absorption per unit area of the test specimens. The Noise Reduction Coefficient (NRC) is a four-frequency average of the Sound Absorption Coefficient. A rotation microphone boom and a Norsonic Instruments NI-830 Dual Channel Real Time Analyzer, computer controlled using custom software, were used for all measurements. Measurements were made in the ISO-Preferred one-third octave bands from 100 Hz to 5000 Hz. Data obtained from said testing is displayed in FIG. 11.

Said data indicate that the NRC of the acoustic device of this invention is better than 1.20 at sound frequencies below 125 Hz, and generally better than 1.70 at frequencies above 125 Hz.

Figure 5:
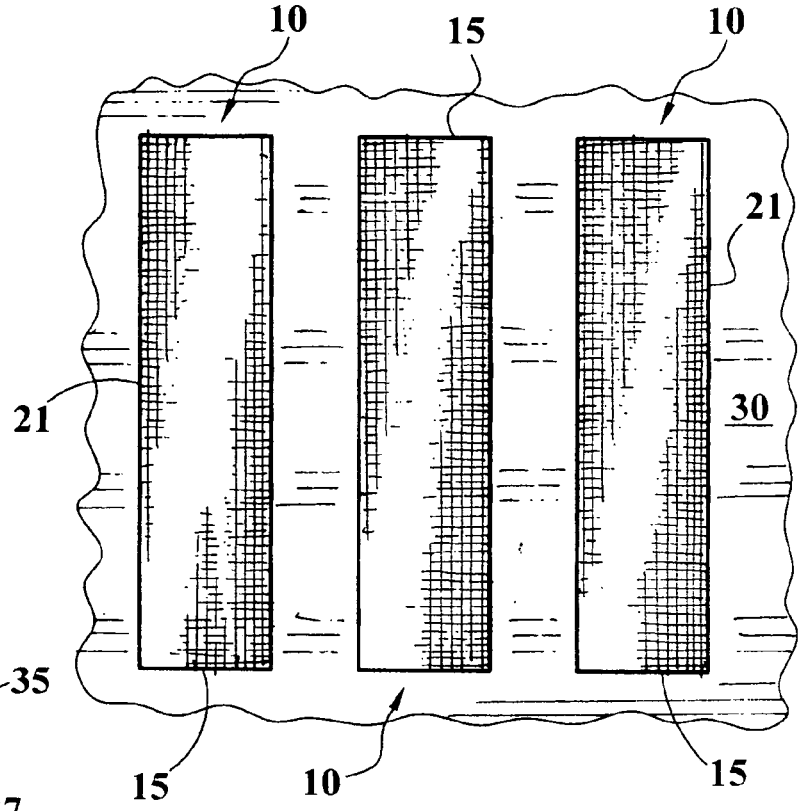
FIG. 5 is a front view of an assemblage of said acoustic devices mounted upon a wall as a uniformly spaced array.
Figure 4:
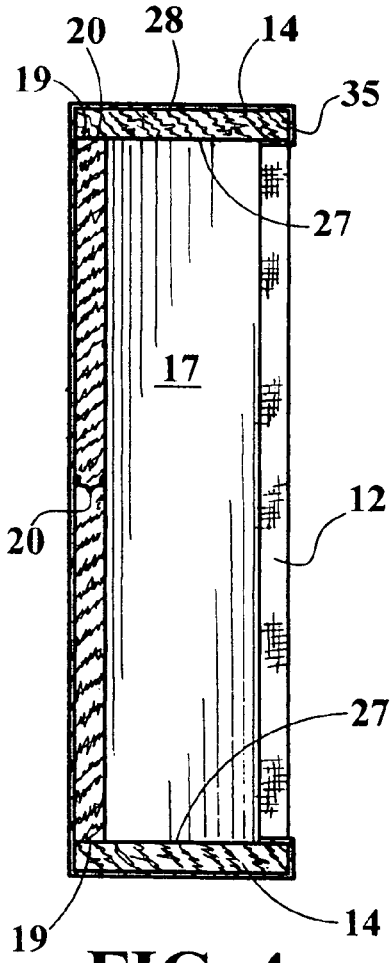
FIG. 4 is a vertical sectional view taken in the direction of the arrows upon line 4—4 of FIG. 2.

The acoustic device of this invention is intended to be mounted upon a flat wall 30, as shown in FIG. 5 in a manner such that the long axis of the device is vertically oriented. A plurality of the devices, preferably of identical size, are preferably arranged in a uniformly spaced apart parallel array as an operating assemblage. The particular length and diameter of the devices is dictated by the size of the room and the type of sound modification sought.

Figure 7:
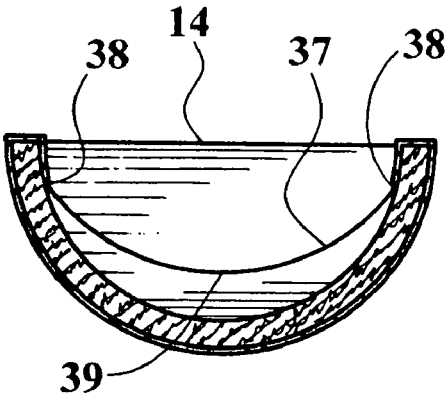
FIG. 7 is a lateral sectional view of a second embodiment of the acoustic device of this invention.
Figure 8:
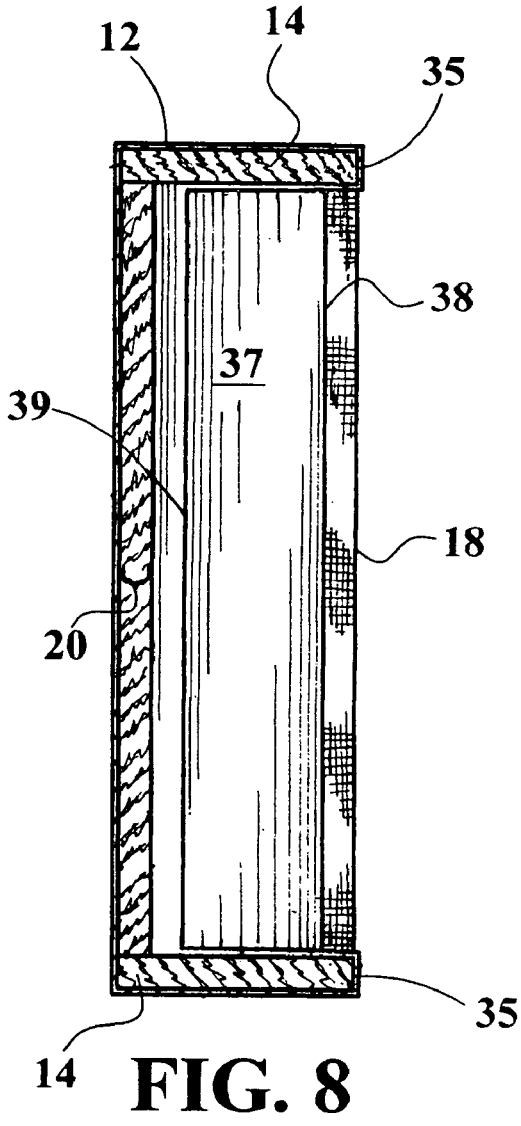
FIG. 8 is a vertical sectional view of the embodiment of FIG. 7.

The second embodiment of acoustic device of this invention, as exemplified in FIGS. 7 and 8, differs from the embodiment of FIGS. 1–6 insofar as a resilient diaphragm 37 is disposed behind interior surface 17 of mat 11. The exemplified diaphragm is of elongated shape, extending substantially the entire distance between, but not touching, end panels 14, and is attached at its lateral extremities 38 to interior surface 17. The manner of attachment is such as to cause the diaphragm to be flexed to an arcuate shape directed toward mat 11. The separation distance between the diaphragm and interior surface, at the mid point 39 of the diaphragm is preferably between 1 and 5 inches. The diaphragm may be fabricated of stiff, but not rigid plastic sheet stock having a thickness between about 0.3 and 1.3 mm. A particularly suitable sheet stock is a resin-impregnated fiberglass sheet. Such material has a relatively low bending modulus but extremely high tensile modulus, causing it to be non-elastic. Because of its resilient nature, and the fact that it is suspended by its lateral extremities, the diaphragm is capable of undergoing vibration in response to sound energy applied thereto.

The diaphragm imparts to the acoustic device greater ability to absorb noise at low frequencies of 125 Hz and below. By way of comparison with the first embodiment, the second embodiment can provide NRC values better than 1.80 at sound frequencies in the range of 50 Hz–125 Hz.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

What is claimed is:

1. A wall-mountable acoustic device for diffusion and absorption of sound in an indoor area, comprising:

a) a self-supporting mat of compacted and interbonded rockwool fibers, said mat linearly elongated between opposite end extremities and bounded by 1) a convex exterior surface of circular cylindric shape extending 180° in circular curvature, 2) a concave interior surface substantially concentric with said exterior surface and extending 180° in circular curvature, 3) two diametrically opposed straight flat rear surfaces in parallel and coplanar juxtaposition, having identical widths which represent the thickness of the mat as measured orthogonally between said interior and exterior surfaces, and 4) opposed flat end surfaces having a semicircular perimeter, b) a thin facing material tautly embracing said exterior surface and extending across said rear surfaces and onto said interior surface, and c) an end panel of flat contour disposed upon each end surface and extending between said exterior surface and rear surfaces, and having a back surface disposed in substantially coplanar relationship with said rear surfaces and in a rectangular configuration therewith, whereby, d) when said device is mounted upon a wall by way of abutment with said rear and back surfaces, said mat, end panels and wall define a fully enclosed internal chamber of semi-cylindrical configuration.

2. An assemblage comprising a vertically oriented array of at least two of the acoustic devices of claim 1 in parallel juxtaposition.

3. An acoustically modified wall having mounted thereupon at least one of the devices of claim 1 in vertical alignment.

4. The acoustic device of claim 1 wherein the thickness of said mat is between 1 and 3 inches, and the length of said mat, measured between said end extremities is between 2 and 6 feet.

5. The acoustic device of claim 4 wherein the diametric width of said mat, measured between said opposed straight flat rear surfaces, is between 16 and 30 inches.

6. The acoustic device of claim 5 wherein the ratio of the length to the diametric width of the mat is between 1.4 and 3.0.

7. The acoustic device of claim 5 wherein the ratio of the thickness of the mat to its diametric width is between 0.6 and 0.12.

8. The acoustic device of claim 1 wherein said mat of interbonded rockwool fibers has a density between 5 and 9 pounds per cubic foot.

9. The acoustic device of claim 8 wherein said mat of interbonded rockwool fibers contains between 3% and 5% by weight of bonding agent.

10. The acoustic device of claim 1 wherein the self-supporting nature of said mat is such that said mat exhibits a sag of not more than ½" in 4 feet when supported horizontally at one end.

11. The acoustic device of claim 1 wherein said mat has a tensile strength of at least 2600 pounds per square foot, and a compressive modulus between 300 and 500 pounds per square foot, measured at 10% compression.

12. The acoustic device of claim 1 wherein said end panels are adhesively secured to said flat end surfaces of semicircular perimeter.

13. The acoustic device of claim 12 wherein said end panels are comprised of the same compacted interbonded rockwool construction that constitutes said self-supporting mat.

14. The acoustic device of claim 1 having an NRC value greater than 1.20 at frequencies below 125 Hz, and greater than 1.70 at frequencies above 125 Hz.

15. The acoustic device of claim 1 further comprising a resilient diaphragm disposed behind said concave interior surface of said self-supporting mat, said diaphragm being of elongated shape, extending substantially the entire distance between, but not touching said end panels, and having lateral extremities that attach to said concave interior surface.

16. The acoustic device of claim 15 wherein said diaphragm is of sufficiently thin and lightweight construction to undergo vibration in response to sound energy applied thereto.

* * * * *